US012173710B2

(12) United States Patent
Lepore et al.

(10) Patent No.: US 12,173,710 B2
(45) Date of Patent: Dec. 24, 2024

(54) VACUUM PUMPING SYSTEM COMPRISING A VACUUM PUMP AND ITS MOTOR

(71) Applicants: Agilent Technologies, Inc., Santa Clara, CA (US); Andrea Lepore, Cassino (IT); Roberto Carboneri, Turin (IT); Andrea Bertallot, Cavour Turin (IT); Giuseppe De Palma, Turin (IT)

(72) Inventors: Andrea Lepore, Cassino (IT); Roberto Carboneri, Turin (IT); Andrea Bertallot, Cavour Turin (IT); Giuseppe De Palma, Turin (IT)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 16/976,741

(22) PCT Filed: Jan. 8, 2019

(86) PCT No.: PCT/IB2019/050128
§ 371 (c)(1),
(2) Date: Aug. 28, 2020

(87) PCT Pub. No.: WO2019/166882
PCT Pub. Date: Sep. 6, 2019

(65) Prior Publication Data

US 2020/0408212 A1 Dec. 31, 2020

(30) Foreign Application Priority Data

Feb. 28, 2018 (IT) ..... 102018000003151

(51) Int. Cl.
*F04C 25/02* (2006.01)
*F04C 2/344* (2006.01)
*F04C 15/00* (2006.01)

(52) U.S. Cl.
CPC ..... *F04C 25/02* (2013.01); *F04C 2/344* (2013.01); *F04C 15/008* (2013.01)

(58) Field of Classification Search
CPC ..... F04C 25/02; F04C 2/344; F04C 15/008
(Continued)

(56) References Cited

U.S. PATENT DOCUMENTS 2,938,468 A * 5/1960 Kececioglu ..... F04C 29/0085 418/91
3,708,251 A 1/1973 Pierro
(Continued)

FOREIGN PATENT DOCUMENTS

CN 2839649 Y 11/2006
CN 106704185 A 5/2017
(Continued)

OTHER PUBLICATIONS

English translation of JP-2008231947-A obtained Oct. 20, 2022 (Year: 2008).*

(Continued)

*Primary Examiner* — Connor J Tremarche

(57) ABSTRACT

A vacuum pumping system includes a vacuum pump and a motor for driving the vacuum pump. A motor stator and a motor rotor are received in a pumping chamber of the vacuum pump. Thanks to such arrangement, the vacuum pumping can be made as a single, sealed unit and the need for dynamic seals can be avoided. Moreover, the vacuum pumping system can be more compact and lighter than prior vacuum pumping systems. A pump rotor of the vacuum pump may be at least partially made as a hollow body, and the motor may be received inside the pump rotor.

10 Claims, 5 Drawing Sheets

(58) Field of Classification Search
USPC ..... 417/410.3
See application file for complete search history.

(56) References Cited

U.S. PATENT DOCUMENTS

| | | | | |
|---|---|---|---|---|
| 4,006,804 | A | 2/1977 | Fehr | |
| 4,384,828 | A | 5/1983 | Rembold et al. | |
| 5,836,746 | A * | 11/1998 | Maruyama | F04C 29/0085 417/205 |
| 6,249,071 | B1 | 6/2001 | Lopatinsky et al. | |
| 9,316,229 | B2 * | 4/2016 | Tamaoka | F04D 25/0633 |
| 2005/0156470 | A1 * | 7/2005 | Gromoll | H02K 5/203 310/58 |
| 2006/0119198 | A1 * | 6/2006 | Chio | H02K 7/14 417/423.1 |
| 2006/0186749 | A1 | 8/2006 | Strydom | |
| 2008/0067882 | A1 * | 3/2008 | Murata | H02K 9/20 310/54 |
| 2008/0219875 | A1 * | 9/2008 | Nishikata | F04C 2/3442 418/104 |
| 2009/0081059 | A1 | 3/2009 | Seki et al. | |
| 2012/0163997 | A1 | 6/2012 | Shepard et al. | |
| 2013/0039785 | A1 | 2/2013 | Davidson et al. | |
| 2013/0101412 | A1 * | 4/2013 | Mitsuhashi | F04C 29/0078 415/220 |
| 2014/0363319 | A1 * | 12/2014 | Carboneri | F04C 29/045 417/372 |
| 2016/0010646 | A1 | 1/2016 | Hess et al. | |
| 2017/0100528 | A1 | 4/2017 | Wampler et al. | |
| 2021/0102537 | A1 | 4/2021 | Wang et al. | |

FOREIGN PATENT DOCUMENTS

| | | | | |
|---|---|---|---|---|
| EP | 0044530 | A1 | 1/1982 | |
| EP | 674105 | B1 | 5/1998 | |
| EP | 1591663 | | 9/2011 | |
| EP | 2985883 | A2 | 2/2016 | |
| JP | 6267286 | A | 3/1987 | |
| JP | H0988845 | A | 3/1997 | |
| JP | 2008231947 | A * | 10/2008 | |
| JP | 2011185229 | A | 9/2011 | |
| WO | 2013037540 | A1 | 3/2013 | |
| WO | 2014096494 | A1 | 6/2014 | |
| WO | WO-2014096474 | A1 * | 6/2014 | C07C 225/22 |
| WO | 2015144496 | A1 | 10/2015 | |
| WO | 2015198224 | A1 | 12/2015 | |

OTHER PUBLICATIONS

English Translation of WO-2014096474-A1 obtained May 16, 2023 (Year: 2014).*

Hiroyuki, Onuma, et al; "Development of a Small Magnetic Levitated Centrifugal Blood Pump Using a Radial Type Self-Bearing Motor and Axial Position Change of Rotor-Impeller by Rotational Magnetic Field"; Mechanical Engineering Journal; vol. 4, No. 5; pp. 1-12; 2017.

Instruction Manual—PMFR Series With Body in PPS; Fluid-o-Tech Int'l Inc; 2 pages.

PCT International Search Report mailed Mar. 20, 2019 for Application No. PCT/IB2019/050128; 10 pages.

Chinese Office Action and Search Report dated Feb. 11, 2022 for application No. 201980016159.3; 8 pages.

* cited by examiner

VACUUM PUMPING SYSTEM COMPRISING A VACUUM PUMP AND ITS MOTOR

RELATED APPLICATIONS

This application is the national stage under 35 U.S.C. 371 of International Application No. PCT/IB2019/050128, filed Jan. 8, 2019, which claims priority to Italian Application No. IT 102018000003 15 1, filed Feb. 28, 2018, the entire contents of both of which are incorporated by reference herein.

TECHNICAL FIELD

The present invention relates to a vacuum pumping system comprising a vacuum pump and a motor for driving said vacuum pump.

More particularly, the present invention relates to an improved vacuum pumping system which is more reliable compared to prior art vacuum pumping systems, as well as lighter and more compact than such prior art vacuum pumping systems.

BACKGROUND ART

Vacuum pumps are used to achieve vacuum conditions, i.e. for evacuating a chamber (so-called "vacuum chamber") for establishing sub-atmospheric pressure conditions in said chamber. Many different kinds of known vacuum pumps—having different structures and operating principles—are known and each time a specific vacuum pump can be selected according to the needs of a specific application, namely according to the degree of vacuum that is to be attained in the corresponding vacuum chamber.

In general, a vacuum pump comprises a pump housing, in which one or more pump inlet(s) and one or more pump outlet(s) are provided, and pumping elements, arranged in said pump housing and configured for pumping a gas from said pump inlet(s) to said pump outlet(s): by connecting the pump inlet(s) to the vacuum chamber, the vacuum pump allows the gas in the vacuum chamber to be evacuated, thus creating vacuum conditions in said chamber.

More specifically, several different kinds of vacuum pumps are known in which the pumping elements comprise a stationary stator and a rotatable rotor, which cooperate with each other for pumping the gas from the pump inlet(s) to the pump outlet (s). In such vacuum pumps, the rotor is generally mounted to a rotating shaft which is driven by a motor, namely by an electric motor.

By way of example, a vacuum pumping system according to prior art is schematically shown in FIGS. 1 and 2.

In the example shown in FIGS. 1 and 2 the vacuum pumping system 150 comprises a rotary vane vacuum pump 110; rotary vane vacuum pumps are generally used to attain low vacuum conditions, i.e. in a pressure range from atmospheric pressure down to about $10^{-1}$Pa.

As shown in FIGS. 1 and 2, a conventional rotary vane vacuum pump 110 generally comprises an outer housing 112, receiving an inner housing 114 within which a stator surrounding and defining a cylindrical pumping chamber 116 is defined. The pumping chamber 116 accommodates a cylindrical rotor 118, which is eccentrically located with respect to the axis of the pumping chamber 116; one or more radially movable radial vanes 120 (two in the example shown in FIG. 2) are mounted on said rotor 118 and kept against the wall of the pumping chamber 116 by means of springs 122.

During operation of the vacuum pump 110, gas is sucked from a vacuum chamber through an inlet port 124 of the pump and passes, through a suction duct 126, into the pumping chamber 116, where it is pushed and thus compressed by vanes 120, and then it is exhausted through an exhaust duct 128 ending at a corresponding outlet port 130.

A proper amount of oil is introduced from an oil tank (not shown) into the outer casing 112 for acting as coolant and lubricating fluid. In the example shown in FIG. 2, for instance, the inner casing 114 is immersed in an oil bath 132.

In order to drive the rotor 118 of the vacuum pump, the vacuum pumping system 150 further comprises a motor 140 and the pump rotor 118 is mounted to a rotation shaft which is driven by said motor.

The motor 140 generally is an electric motor comprising a stationary stator and a rotating rotor cooperating with each other and an output shaft connected to the motor rotor: according to a first possible arrangement, the output shaft of the motor rotor is connected to the rotation shaft of the pump rotor by a mechanical or magnetic coupling for driving the pump rotor in rotation; according to a second, alternative arrangement, the output shaft of the rotor motor can be integral with the rotation shaft of the pump rotor, so as to drive the pump rotor in rotation.

A vacuum pumping system as shown in FIGS. 1 and 2 is disclosed, for instance, in EP 1 591 663 by the same Applicant.

Known vacuum pumping systems of the kind disclosed above have several drawbacks.

First of all, it has to be considered that, during operation of the vacuum pump, the motor may be at atmospheric pressure, while the pumping chamber of the vacuum pump receiving the pump rotor may be at sub-atmospheric pressure. Therefore, a dynamic seal is to be provided between the output shaft of the motor rotor and the rotation shaft of the pump rotor.

Dynamic seals are more expensive and less reliable than static seals and a failure of the dynamic seals can involve malfunctioning of the vacuum pump and damages to the vacuum pump and to the vacuum chamber connected thereto. Moreover, in the case of vacuum pumping systems comprising a rotary vane vacuum pump, these dynamic seals are the main cause of oil leaks during operation of the pump.

Secondly, a vacuum pumping system comprising a vacuum pump and its juxtaposed motor is bulky and heavy, which represents a severe drawback during shipping of the vacuum pumping system and installation thereof, especially in those applications in which little room is available.

Moreover, if the motor is cantilevered on the vacuum pump (as shown in FIG. 1), the output shaft of the motor rotor and the rotation shaft of the pump rotor are subjected to flexure stresses, which increase as the size and weight of the vacuum pump and of the motor increase.

It is therefore an object to overcome the above-mentioned drawbacks of prior art, by providing a more reliable vacuum pumping system, in which the need for dynamic seals is avoided.

It is a further object to provide a vacuum pumping system which is lighter and more compact than vacuum pumping systems according to prior art.

The above and other objects are achieved by means of a vacuum pumping system as disclosed herein.

SUMMARY

According to embodiments of the present disclosure, the motor stator and the motor rotor are received in the pumping chamber of the vacuum pump.

Preferably, the motor stator and the motor rotor, as well as the pump stator and the pump rotor, are entirely received in said pumping chamber.

In the context of this description, the term "pumping chamber" can be understood as the space inside the pump housing, which is defined by the pump stator and in which the pump rotor is received and carries out the pumping action by cooperating with the pump stator.

During operation of the vacuum pump the pressure within the pumping chamber is typically not constant and/or equal to the atmospheric pressure; on the contrary, it varies between a minimum value lower than the atmospheric pressure and a maximum value greater than the atmospheric pressure during expansion and compression phases of the pumping action of the pump rotor and stator.

According to embodiments of the present disclosure, during operation of the pump, the motor stator and the motor are substantially at the same pressure as the pump stator and the pump rotor.

As the motor stator and the motor are substantially at the same pressure as the pump stator and the pump rotor, the vacuum pumping system according to embodiments of the present disclosure can be made as a single, sealed unit and no dynamic seal between the vacuum pump and its motor is needed.

Even if static seals are provided in the vacuum pumping system (for instance, for electric connections), static seals are cheaper than dynamic seals and, most importantly, are not subjected to fatigue, so that there is no risk of deterioration and failure of these static seals due to fatigue.

According to a preferred embodiment, the pump rotor is at least partially made as a hollow body and the motor is received inside the pump rotor.

Preferably, said pump rotor is completely made as a hollow body, more particularly as a hollow cylinder.

According to this preferred embodiment, the motor rotor is fastened to or integral with the inner surface of the cavity provided in the pump rotor and the motor stator is located inside said cavity.

According to a particularly preferred embodiment, the motor rotor comprises one or more permanent magnets fastened to or integral with the inner surface of the cavity of the pump rotor and the motor stator is arranged inside said cavity and comprises a body made of a ferromagnetic material and carrying one or more corresponding windings.

The aforesaid preferred embodiment involves several additional advantages.

The vacuum pumping system can be made compact and light, which is particularly advantageous during shipping and installation of the vacuum pumping system.

During rotation of the pump rotor, the pump rotor can be suspended inside the pumping chamber, which allows to reduce the power absorbed by the pump; moreover, due to the fact that the pump rotor can be suspended inside pumping chamber, the noise generated by the vacuum pump may be reduced and vibrations generated by the vacuum pump may be also reduced, which may increase working life and reliability of the pump itself.

According to a preferred embodiment, the pump rotor can be concentrically driven with respect to the longitudinal axis of the motor stator arranged in the cavity of said pump rotor.

According to another preferred embodiment, the pump rotor can be eccentrically driven with respect to the longitudinal axis of the motor stator arranged in the cavity of said pump rotor.

Embodiments disclosed herein can be implemented in several different vacuum pumping systems, comprising different kinds of vacuum pumps.

By way of non-limiting examples, embodiments disclosed herein can be implemented in a vacuum pumping system including a rotary vane vacuum pump, in a vacuum pumping system including a scroll vacuum pump, and so on.

BRIEF DESCRIPTION OF DRAWINGS

Further features and advantages of the present subject matter will become more evident from the detailed description of embodiments, given by way of non-limiting example, with reference to the accompanying drawings, in which.

DETAILED DESCRIPTION

In the following, embodiments of the present disclosure will be described in detail with reference by way of non-limiting example to a vacuum pumping system comprising a rotary vane vacuum pump. In any case, it is to be noted that the present subject matter could also be applied to vacuum pumping systems including a different kind of vacuum pump, such as for instance a scroll vacuum pump.

Figure 1:
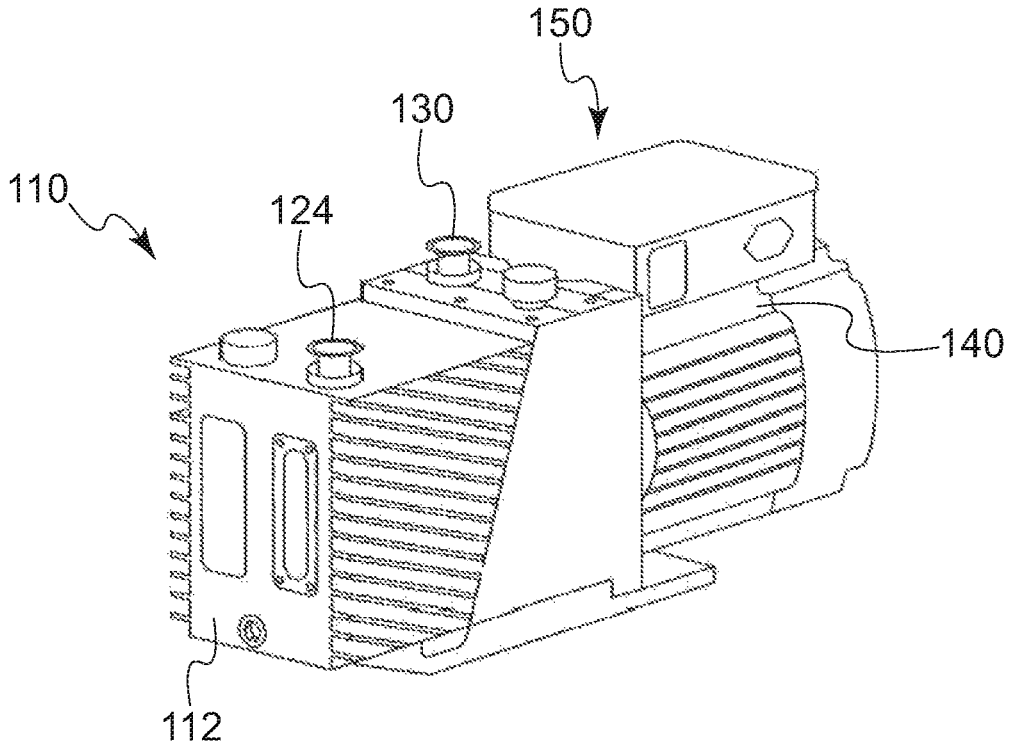
Fig. 1 (PRIOR ART)
FIG. 1 is a schematic perspective view of a vacuum pumping system according to prior art.
Figure 2:
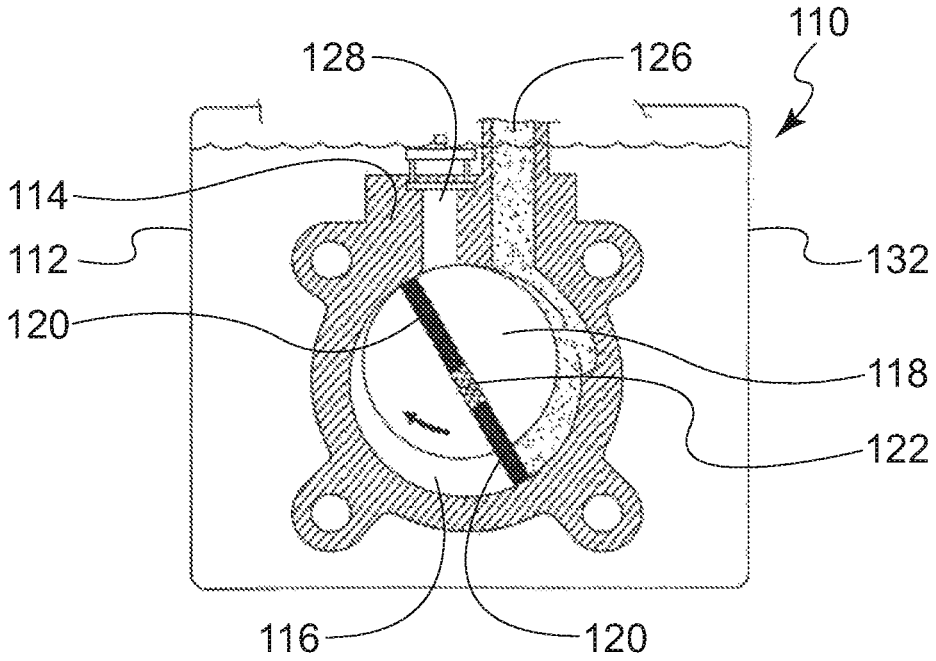
Fig. 2 (PRIOR ART)
FIG. 2 is a schematic cross-sectional view of the vacuum pump of the vacuum pumping system of FIG. 1.
Figure 3:
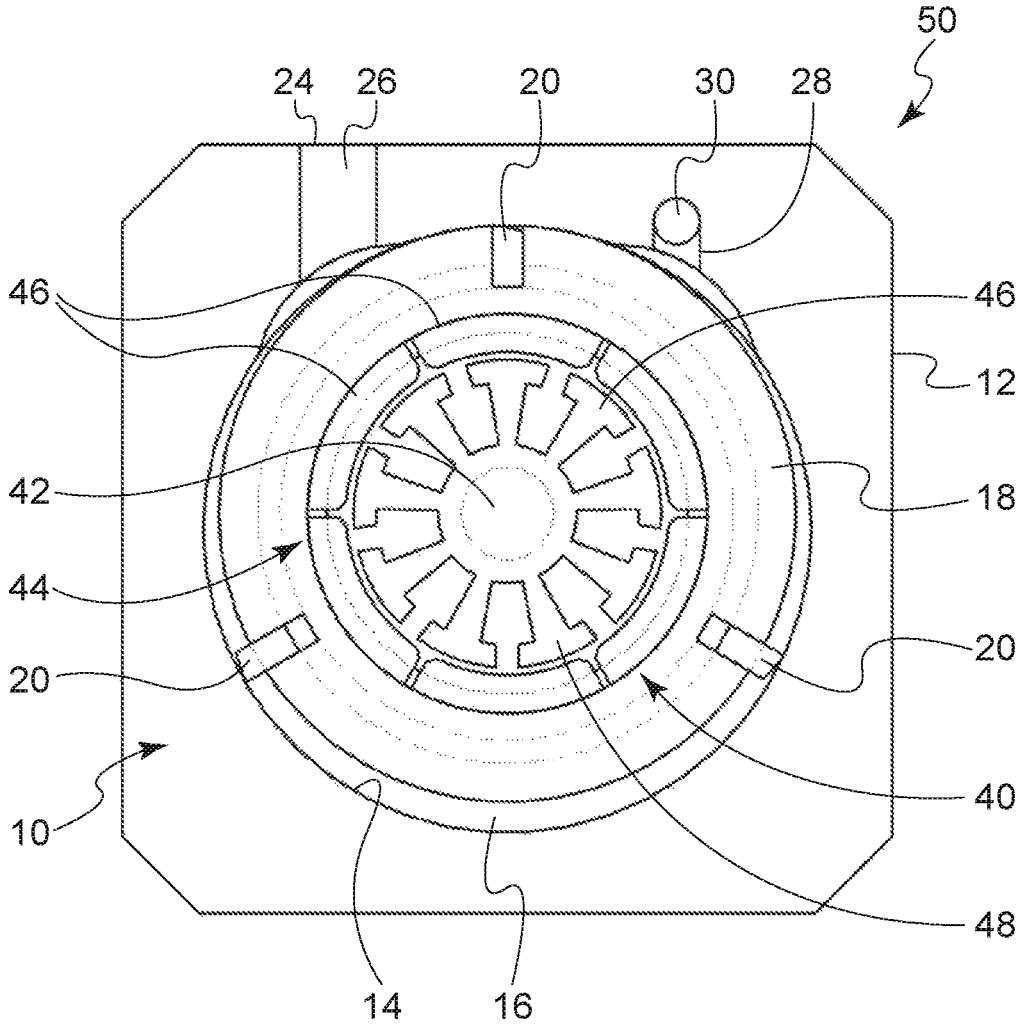
FIG. 3 is a schematic cross-sectional view of a vacuum pumping system according to a first embodiment of the present invention.
Figure 4:
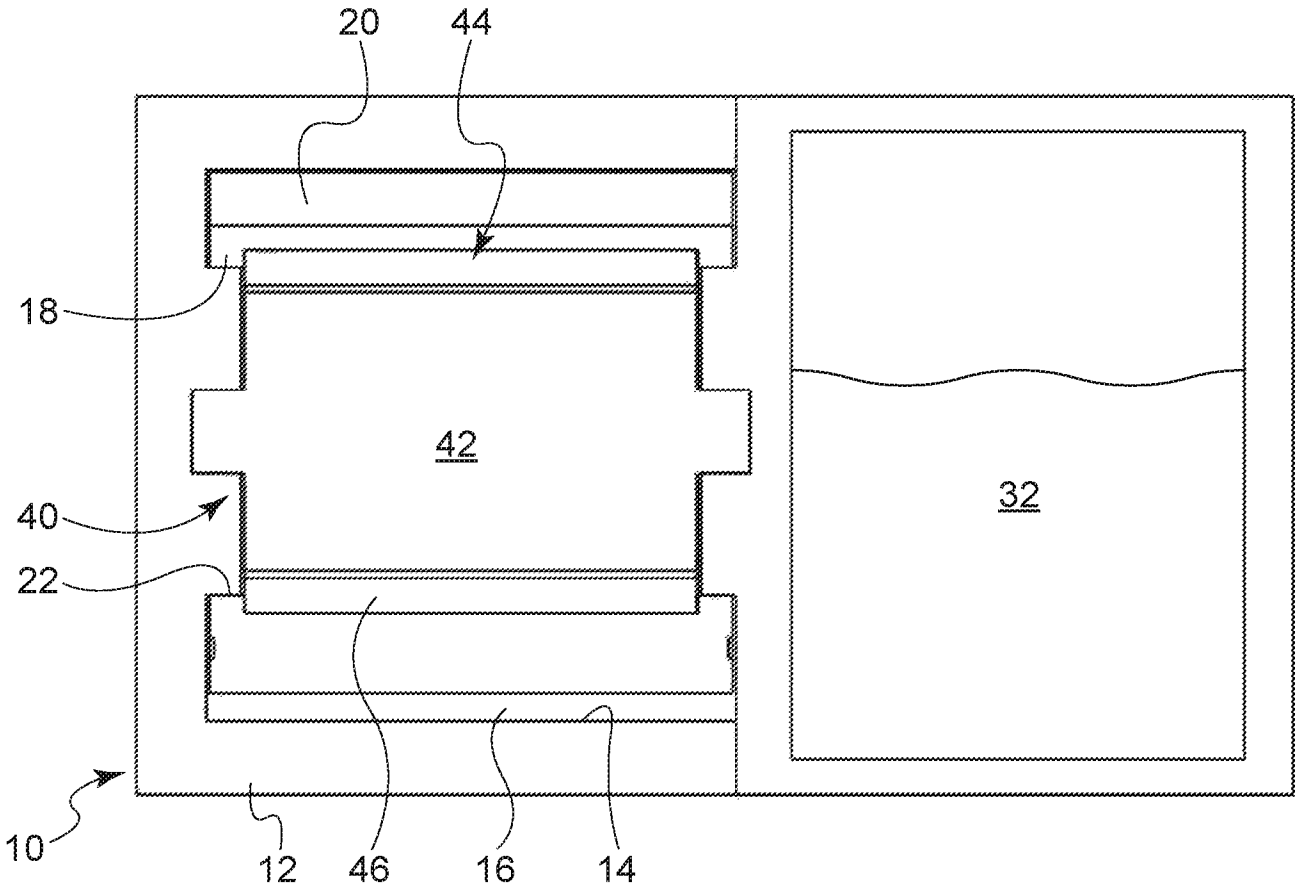
FIG. 4 is a schematic longitudinal sectional view of the vacuum pumping system of FIG. 3.

Referring to FIGS. 3-4, a vacuum pumping system 50 comprising a rotary vane pump 10 and its motor 40 is shown.

In a manner known per se, the rotary vane vacuum pump 10 comprises a pump housing 12, in which a pump inlet 24 and a pump outlet 30 are provided and which receives pumping elements for pumping a gas from said pump inlet 24 to said pump outlet 30.

In the shown embodiment, the pumping elements comprise a stationary pump stator 14 and a rotatable rotor 18.

The pump housing 12 receives the stationary pump stator 14 which surrounds and defines a pumping chamber 16 (which has a cylindrical shape in the shown embodiment), which is connected with the pump inlet 24 and the pump outlet 30. The pumping chamber 16 accommodates a rotatable cylindrical rotor 18, which is eccentrically located with respect to the axis of said cylindrical pumping chamber 16. One or more radially movable radial vanes 20 (three in the example shown in FIG. 3) are mounted on said pump rotor 18 and are kept against the wall of the pumping chamber 16 either by means of corresponding springs (not shown) or by the centrifugal force.

When the vacuum pump 10 is running, gas is sucked from a vacuum chamber (not shown) to be evacuated through the pump inlet 24 of the vacuum pump 10 and passes through an inlet duct 26 into the pumping chamber 16 where it is pushed and thus compressed by the vanes 20, and then it is exhausted through an exhaust duct 28 ending at the pump outlet 30.

Oil is introduced from an oil tank 32 connected to the vacuum pump 10, so that the pump housing 12 is immersed in an oil bath, which acts as coolant and lubricating fluid.

The vacuum pumping system 50 further comprises a motor 40 for driving in rotation the pump rotor 18.

According to embodiments of the invention, the motor 40 is located in the pumping chamber 16 of the vacuum pump 10.

As the motor stator 42 and the motor rotor 44 are located in the pumping chamber 16, said motor stator 42 and said motor rotor 44 always are at substantially the same pressure conditions as the pump stator 14 and the pump rotor 18 during operation of the vacuum pump 10.

In order to receive the motor 40 in the pumping chamber 16, in the disclosed preferred embodiment, the pump rotor 18 is made, at least in part, as a hollow body, so that a cavity 22 is defined within the body of said pump rotor 18 and the motor 40 is at least partially, and preferably entirely, received within said cavity 22.

More particularly, a cylindrical cavity 22 is defined in the cylindrical pump rotor 18, which cavity 22 is parallel to and concentric with the body of said pump rotor 18, and the motor 40 is received within said cylindrical cavity 22

In the shown embodiment, the cavity 22 extends over the whole axial length of the pump rotor 18, so that said pump rotor 18 has the overall shape of a hollow cylinder. However, in alternative embodiments, the cavity 22 could extend over a portion only of the axial length of the pump rotor 18.

In the shown embodiment, the motor 40 is a permanent magnet motor and the motor rotor 44 comprises a plurality of permanent magnets 46 which are fixed to the inner surface of the cavity 22 of the pump rotor 18.

As the permanent magnets 46 of the motor rotor 44 are fixed to the inner surface of the cavity 22 of the pump rotor 18, the motor rotor 44 and the pump rotor 18 together form a single rotor unit.

These permanents magnets 46 are shaped as slightly curved, rectangular slabs, arranged substantially parallel to the longitudinal axis of the pump rotor 18 and extending over a substantial portion of the axial length of the cavity 22, said slabs being equally spaced along the inner wall of the cavity 22 in the circumferential direction.

Said slabs (permanent magnets 46) preferably are even in number and they are arranged so that the polarity of each slab is opposite to the polarity of the adjacent slabs.

It will be evident to the person skilled in the art that the motor rotor 44 could also be made with a different shape. For instance, such motor rotor 44 could be made as a cylindrical sleeve fitted into the cavity 22 of the pump rotor 18. Furthermore, the motor rotor 44 could be made integral with the inner surface of the cavity 22 of the pump rotor 18. Even in these alternative embodiments, the motor rotor 44 and the pump rotor 18 together form a single rotor unit.

The motor stator 42 is located inside the cavity 22 of the pump rotor 18 is fastened to or integral with the pump housing 12 and/or the pump stator 14. Said motor stator 42 comprises a body made of ferromagnetic material (such as, ferrite, SMC materials and the like), having substantially the same axial length as the permanent magnets 46 and provided with a plurality of radial arms 48 carrying respective windings (not shown).

In the shown embodiment, the motor stator 42 is made as a generally cylindrical body arranged parallel to and concentric with the cylindrical cavity 22. In other words, the air gap between the motor stator 42 and the motor rotor 44 has a constant width along the circumference of said motor stator 42 and motor rotor 44. Accordingly, in the shown embodiment, the motor rotor 44 and the pump rotor 18 are concentrically driven with respect to the longitudinal axis of said motor stator 42 (i.e. to the longitudinal axis of the cavity 22).

However, in alternative embodiments of the invention, it is possible that the motor stator 42 is made as a cylindrical body arranged parallel to the cylindrical cavity 22 but in an eccentric position with respect to the longitudinal axis of said cavity 22. In other words, the air gap between the motor stator 42 and the motor rotor 44 has a width at each point along the circumference of said motor stator 42 and motor rotor 44 which is variable over time. Accordingly, in such embodiments, the motor rotor 44 and the pump rotor 18 would be eccentrically driven with respect to the longitudinal axis of said motor stator 42 (i.e. to the longitudinal axis of the cavity 22) and the axis of the motor rotor 44 (and of the pump rotor 18) moves following a circular or elliptical trajectory.

It is evident from the above, that the arrangement according to embodiments of the invention allows to avoid the need for dynamic seals between the vacuum pump 10 and the motor 40, since the motor 40 is located in the pumping chamber 16 of the vacuum pump 10, as is the pump stator 14 and pump rotor 18.

While in vacuum pumping systems according to prior art the motor typically is at atmospheric pressure during operation of the vacuum pump, in the vacuum pumping system 50 according to embodiments disclosed herein, the motor stator 42 and the motor rotor 44 always are at the same pressure as the pump stator 14 and the pump rotor 18 during operation of the vacuum pump 10.

It is evident from the above that, due to the absence of dynamic seals, the vacuum pumping system 50 according to embodiments disclosed herein is more reliable. In case of applications to vacuum pumping systems including a rotary vane vacuum pump, leaks of oil through the dynamic seals are prevented.

It is also evident from the above that the arrangement according to embodiments disclosed herein allows to obtain a very compact design, as well as a vacuum pumping system formed by fewer components and lighter than those of prior art.

It will be further evident from the above that, thanks to the cooperation of the motor stator 42 and the motor rotor 44, during rotation of the pump rotor 18, said pump rotor 18 is magnetically suspended without contact inside the pumping chamber 16, which involves a remarkable reduction of the noise generated by the vacuum pump 10 as well as of the vibrations generated by the vacuum pump 10, thus increasing the working life and reliability of the vacuum pumping system 50.

The vacuum pump 10 is closed at both its axial ends and the pump rotor 18 can be provided, at both its axial ends, with bushings (not shown), interposed between said pump rotor 18 and the pump housing 12, which in turn is provided with seats for receiving said bushings. Due to the fact that the pump rotor 18 is suspended during operation of the vacuum pump 10, there is no contact on the bushings and such absence of contact advantageously involves a reduction in the power absorbed by the vacuum pump 10.

Figure 5:
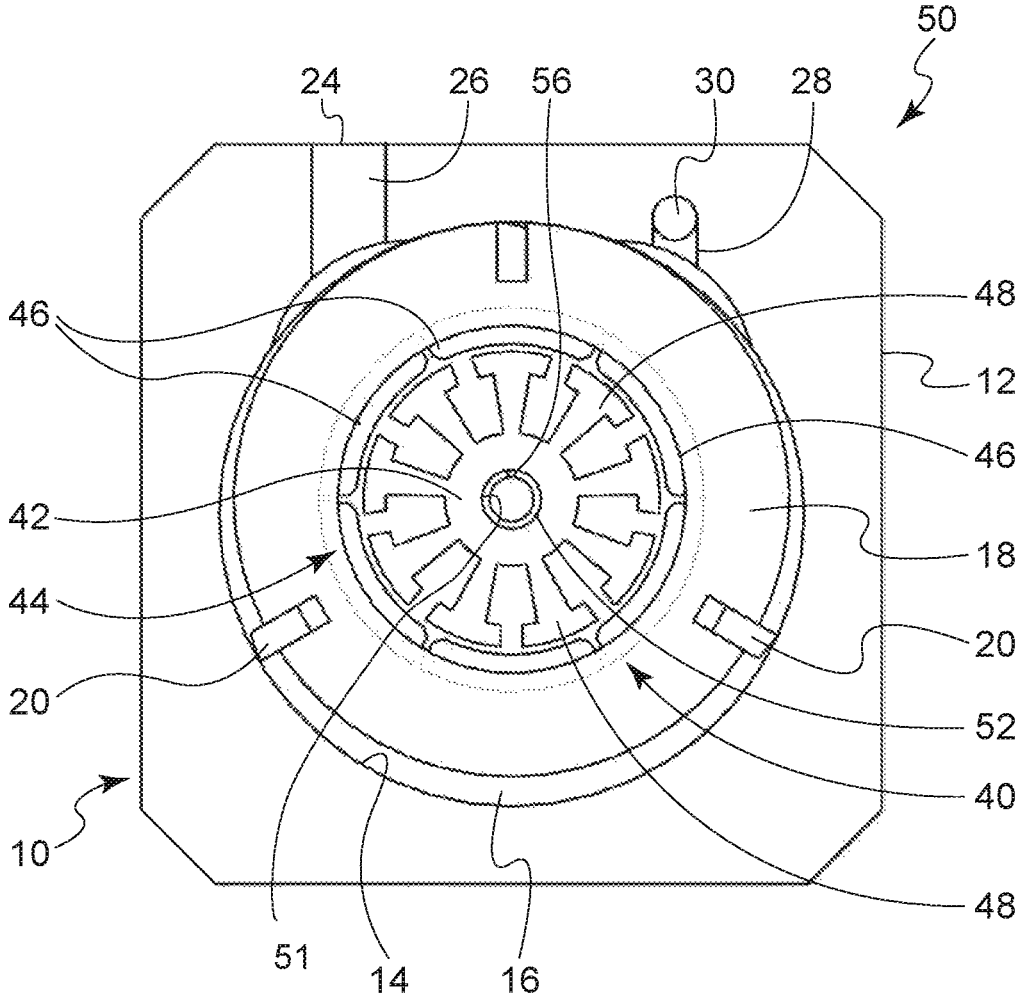
FIG. 5 is a schematic cross-sectional view of a vacuum pumping system according to a second embodiment of the present invention.
Figure 6:
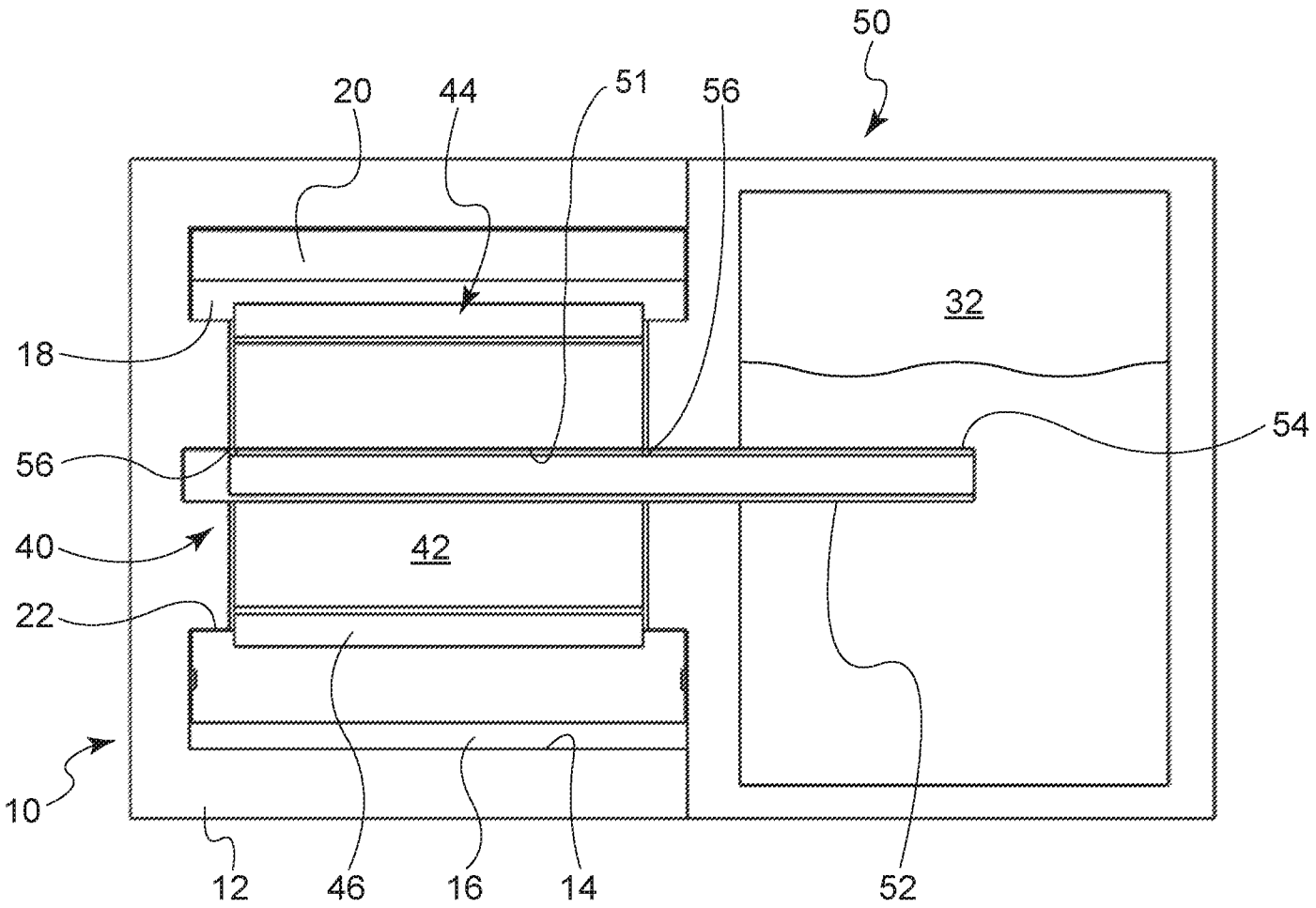
FIG. 6 is a schematic longitudinal sectional view of the vacuum pumping system of FIG. 5.

With reference now to FIGS. 5 and 6, a second embodiment according to the presently disclosed subject matter is shown.

This second embodiment is almost identical to the first embodiment disclosed above and the same numerals used in FIGS. 3-4 are also used in FIGS. 5-6 for denoting identical or similar parts of the vacuum pumping system 50.

This second embodiment differs from the first embodiment in that the motor stator 42 is provided with one or more longitudinal through-hole(s) 51 (only one, centrally arranged through-hole in the example shown in FIGS. 5-6) accommodating respective pipe(s) 52.

The pipe 52 extends through the motor stator 42 and projects into the adjacent oil tank 32, ending with a mouth 54 which is always below the level of oil in the oil tank 32 during operation of the vacuum pumping system 50.

At the cold start of a rotary vane vacuum pump, the required torque may be very high, mainly because of the oil viscosity that is strongly dependent on the temperature and is very high at low temperature.

The pipe 52 can be advantageously used for transferring heat from the motor stator 42 to the oil bath 32 before starting the vacuum pump 10, so as to increase the oil temperature and reduce its viscosity.

More in detail, at the cold start of the vacuum pumping system 50, the windings of the motor stator 42 can be energized while keeping the motor rotor 44 stationary. In such conditions, the power delivered to the motor stator 42 is not used for making the motor rotor 44 rotate, but it is dissipated as heat, thus leading to an increase of the motor stator temperature.

This heat can be transferred from the motor stator 42 to the oil tank 32 thanks to the pipe 52, which to this purpose is preferably made of a material having a high thermal conductivity.

When the motor rotor 44 is successively made to rotate, the oil viscosity will be decreased and the required torque will be correspondingly reduced.

Another advantage of this second embodiment is that the pipe 52 can be further exploited for cooling the vacuum pump 10 during operation.

In fact, during operation of the vacuum pump 10, oil is sucked from the oil tank 32 through the pipe 52 and into the vacuum pump 10. To this purpose, the pipe 52 is provided with radial orifices 56 at both axial ends of the motor stator 42.

This arrangement turns out to be particularly effective, as the oil is introduced in the vacuum pump 10 close to the longitudinal axis of the vacuum pump 10 itself.

It is evident that the above disclosure has been given by way of non-limiting example and that several variants and modifications within the reach of the person skilled in the art are possible, without departing from the scope of the invention as defined by the appended claims.

For instance, although in the description above reference has been made to a vacuum pumping system including a rotary vane vacuum pump, the subject matter disclosed herein could also be implemented in vacuum pumping systems including a different kind of vacuum pump, such as a scroll vacuum pump.

Analogously, although in the description of above reference has been made to a vacuum pumping system including a permanent magnet motor, the subject matter disclosed herein could also be implemented in vacuum pumping systems including a different kind of motor, such as a squirrel cage motor.

The invention claimed is:

1. A vacuum pumping system, comprising:

a rotary vane vacuum pump comprising:

a pump housing comprising a pump inlet, a pump outlet, a stationary pump stator defining a pumping chamber, and a pump rotor arranged in the pumping chamber and comprising one or more vanes, wherein the pump inlet is configured to communicate with a vacuum chamber, and the pump stator and the pump rotor are configured to cooperate with each other for pumping a gas from the pump inlet to the pump outlet to evacuate the vacuum chamber;

an oil tank connected to the pumping chamber and configured to supply oil for both lubricating and cooling the vacuum pump; and a motor comprising a motor stator and a motor rotor, wherein the motor stator and the motor rotor are configured to cooperate with each other for driving rotation of the pump rotor, and wherein:

the motor stator and the motor rotor are arranged in the pumping chamber without surrounding the pump rotor, and the motor stator is at least partially surrounded by the pump rotor;

the pump rotor is at least partially made as a hollow body to define a cavity inside the pump rotor;

the motor stator and the motor rotor are arranged in the cavity; and the motor stator and the motor rotor are enclosed by the pump housing and are thereby separated from an environment outside the pump housing.

2. The vacuum pumping system according to claim 1, wherein the cavity comprises an inner surface, the motor rotor is integral with or fastened to the inner surface.

3. The vacuum pumping system according to claim 2, wherein the inner surface of the cavity is a cylindrical surface and the motor rotor is made as a hollow cylindrical body integral with or fastened to the inner surface.

4. The vacuum pumping system according to claim 2, wherein the inner surface of the cavity is a cylindrical surface, and the motor rotor comprises a plurality of separate elements arranged substantially parallel to a longitudinal axis of the pump rotor and spaced apart from one another along the circumference of the inner surface.

5. The vacuum pumping system according to claim 1, wherein the motor rotor comprises one or more permanent magnets, and the motor stator comprises a body made of a ferromagnetic material and radial arms carrying one or more corresponding windings.

6. The vacuum pumping system according to claim 5, wherein the cavity comprises an inner surface, and the one or more permanent magnets are made as slabs arranged substantially parallel to a longitudinal axis of the pump rotor and spaced apart from one another along the circumference of the inner surface.

7. The vacuum pumping system according to claim 5, wherein the pump rotor in cooperation with the motor stator and the motor rotor is configured to be magnetically suspended in the pumping chamber without contacting the pump stator during rotation of the pump rotor.

8. The vacuum pumping system according to claim 1, comprising one or more through-holes extending through the motor stator, and one or more pipes respectively extending through the one or more through-holes and projecting into the oil tank, the one or more pipes being made of a thermally conductive material.

9. The vacuum pumping system according to claim 8, wherein the motor stator comprises axial ends, and the one or more pipes comprise a plurality of radial orifices at either or both of the axial ends.

10. The vacuum pumping system according to claim 1, wherein the rotary vane vacuum pump is configured to generate a sub-atmospheric pressure down to about $10^{-1}$ Pa.

* * * * *